US006745695B2

(12) United States Patent
Liston

(10) Patent No.: US 6,745,695 B2
(45) Date of Patent: Jun. 8, 2004

(54) PRINTING MACHINE WITH FRICTION DRIVEN IMAGE CYLINDER

(75) Inventor: Christopher Liston, Brighton, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/407,023

(22) Filed: Apr. 3, 2003

(65) Prior Publication Data

US 2003/0200882 A1 Oct. 30, 2003

Related U.S. Application Data

(63) Continuation-in-part of application No. 09/858,409, filed on May 16, 2001, now abandoned.
(60) Provisional application No. 60/204,696, filed on May 17, 2000.

(51) Int. Cl.[7] ..... G03G 15/00
(52) U.S. Cl. ..... 101/489; 101/217; 399/167; 399/302; 399/308
(58) Field of Search ..... 101/217, 489; 399/167, 299, 302, 308, 66

(56) References Cited

U.S. PATENT DOCUMENTS

| | | | | | |
|---|---|---|---|---|---|
| 4,987,454 | A | * | 1/1991 | Natsuhara et al. | 399/280 |
| 5,369,478 | A | * | 11/1994 | Kobayashi et al. | 399/236 |
| 5,923,937 | A | * | 7/1999 | Thompson et al. | 399/302 |
| 6,445,896 | B1 | * | 9/2002 | Satoh | 399/174 |
| 6,445,899 | B2 | * | 9/2002 | Sato | 399/284 |
| 6,456,816 | B1 | * | 9/2002 | Chowdry et al. | 399/302 |
| 6,459,874 | B2 | * | 10/2002 | Inoue et al. | 399/223 |

* cited by examiner

*Primary Examiner*—Andrew H. Hirshfeld
*Assistant Examiner*—Dave A. Ghatt
(74) *Attorney, Agent, or Firm*—Lawrence P. Kessler

(57) ABSTRACT

A printing machine having at least one printing unit whose image cylinder is driven by friction by an element to which the image is transferred. The influence of a change in the application of print is kept as small as possible, by the width of image cylinder and element being at least so much wider than the maximum width of the image to be transferred that the rotational speed of the image cylinder remains essentially constant in the event of a change in the image.

6 Claims, 4 Drawing Sheets

PRINTING MACHINE WITH FRICTION DRIVEN IMAGE CYLINDER

CROSS REFERENCE TO RELATED APPLICATION

This is a CIP of U.S. NonProvisional application Ser. No. 09/858,409, filed on May 16, 2001, now abandoned, entitled: PRINTING MACHINE; which claims the priority of the U.S. Provisional Application Serial No. 60/204,696, filed on May 17, 2000, entitled: PRINTING MACHINE.

FIELD OF THE INVENTION

The invention relates to a printing machine having at least one printing unit whose image cylinder is driven by friction by an element to which the image is transferred.

BACKGROUND OF THE INVENTION

In such printing machines, it has been shown that, as a result of a change in the images or the printing substrates, a change in the rotational speed of the image cylinder can occur. Changes which affect the rotational speed are, in relation to the images, the toner application, that is to say, toner thickness, toner distribution and image width and, in relation to the printing substrates, their thickness, width and possibly also other properties of the printing substrate.

This leads to register inaccuracies when the aforementioned variables change from one printed page to the next, since, as a result of the change in the rotational speed of an image cylinder, both the assignment of an image to the printing substrate and the assignment of the color separations to one another become faulty. In order to counteract register faults, in the printing machines of known type, register marks are printed and evaluated in order, for example, to control digital image production appropriately. However, this type of problem solution requires time and, as a result, it is in particular not possible to change seamlessly from one printed page to another without interrupting the running of the machine. Such a seamless transition is opposed by the outlay on time for test prints and evaluation, and by the fact that in the event of changes without interrupting the printing operation, printed pages, which have differences with regard to the images and/or the printing substrates, affect each other. It is particularly important to rule out the influence of such changes if the pages printed one after another have differences in terms of content and paper.

SUMMARY OF THE INVENTION

The invention is, therefore, based on the object of developing a printing machine of the type mentioned at the beginning in such a way that the influence of a change in image contents and/or variables is kept as small as possible. As an additional object, the intention is also for the influence of changes in the printing substrates to be kept as small as possible.

According to the invention, the object is achieved by the width of image cylinder and element being so much wider than the maximum width of the image to be transferred that the rotational speed of the image cylinder remains essentially constant in the event of a change in the image.

The invention is based on the finding that the influence of a change in the aforementioned variables on the rotational speed of the image cylinder driven by friction has an effect only within specific ranges of the image and/or printing-substrate width in its relationship to the width of the image cylinder and of the element driving the image cylinder. In this case, there is a range, once a minimum difference has been exceeded, by which the image cylinder and the element driving the image cylinder are wider than the image width and in which changes in the abovementioned variables no longer exert any significant influence on the rotational speed of the image cylinder. After exceeding this minimum difference, this range is not limited. The invention is based on utilizing this range. However, this range cannot be given in concrete dimensions, since the actual position depends on the configuration of a machine type. It is, therefore, necessary for this range to be determined for each machine type, which can be done empirically, for example. In a corresponding way, there is also such a range in relation to the printing substrates, the elements carrying the printing substrate likewise having to be wider by a minimum dimension than the printing substrates.

The invention makes a printing machine available which, with regard to its register accuracy in the event of changes in the abovementioned variables, exhibits a high constancy. As a result, no corrections, or significantly fewer corrections, to the register are needed in the event of a change in the aforementioned variables. In this way, the lost time to take changes of the aforementioned variables in account is reduced considerably or to zero. It is often the case that, as a result, a printing machine is able to print one printed page after the other printed page, different from the last printed page, seamlessly. The invention, therefore, increases the performance and the register accuracy of a printing machine, and a high degree of economy can even be achieved during the continuous printing of different printed pages or in the case of relatively small editions.

Depending on the configuration of the actual printing machine, the element, which drives the image cylinder by friction, may be an element of a very wide range of types. It can likewise be a cylinder or a web guided by rolls. It can even be the carrier for printing substrates or an image transfer element of any desired design, which transports the images onward to a printing-substrate carrier.

The dimensioning of the width of the image cylinder and that of the element or elements driving the latter depends on the image width if only pure image transfers take place in the drive train for the image cylinder. This dimensioning is based on the printing-substrate width and, as a result, will become greater, by about the width of the print-free edge, if images are transferred to printing substrates in this drive train.

One embodiment of the invention, therefore, provides for the element which drives the image cylinder to be the carrier which carries the printing substrates during the printing operation, and for the width of image cylinder and element to be at least so much wider than the maximum width of the printing substrate that the rotational speed of the image cylinder remains essentially constant in the event of a change in the printing substrates. In this case, instead of the width of the image, the width of the printing substrate has an effect, but the printing substrate either being equally as wide as the image or wider by a mostly relatively narrow image-free edge.

In a different configuration of the printing machine, the element is an image transfer cylinder. If the drive is provided directly via the image transfer cylinder or cylinders, then only the image width is critical for dimensioning the width of the image cylinder and of the image transfer cylinder. If, however, provision is made for the image transfer cylinder to be driven by the carrier for the printing substrates, then provision must also be made here for the width of image cylinder, image transfer cylinder and carrier to be at least so much wider than the maximum width of the printing substrate that the rotational speed of the image cylinder remains essentially constant in the event of a change in the aforementioned variables. In the case of such transfers of force, at least when a printing substrate is led between elements, one of the elements must have a certain elasticity which ensures the transfer of force even without the inclusion of a printing substrate.

Furthermore, provision is preferably made, on the side of the carrier, which is opposite the image transfer, to arrange an impression cylinder, which likewise has at least the abovementioned width. In this case, this is the width, which is dimensioned in accordance with the maximum width of the printing substrate. With regard to the carrier, provision may be made for this to be driven via a drive roller.

The measure according to the invention is preferably used in printing machines in which the image is a toner image, since this has a thickness, a profile and a size which, in normal operation of the machine, very often change from one printed page to the next. These are mostly printing machines, which are equipped with equipment for digital image production, as a rule, equipment for digital electrostatic image production, equipment for toner application and for toner removal then additionally being present. In the case of such printing machines, each image is produced anew, so that a machine of this type is preferably used in a sector in which each printed page is different from the preceding and the following one.

BRIEF DESCRIPTION OF THE DRAWINGS

The invention will be explained below using the drawing, in which.

DETAILED DESCRIPTION OF THE INVENTION

Figure 1:
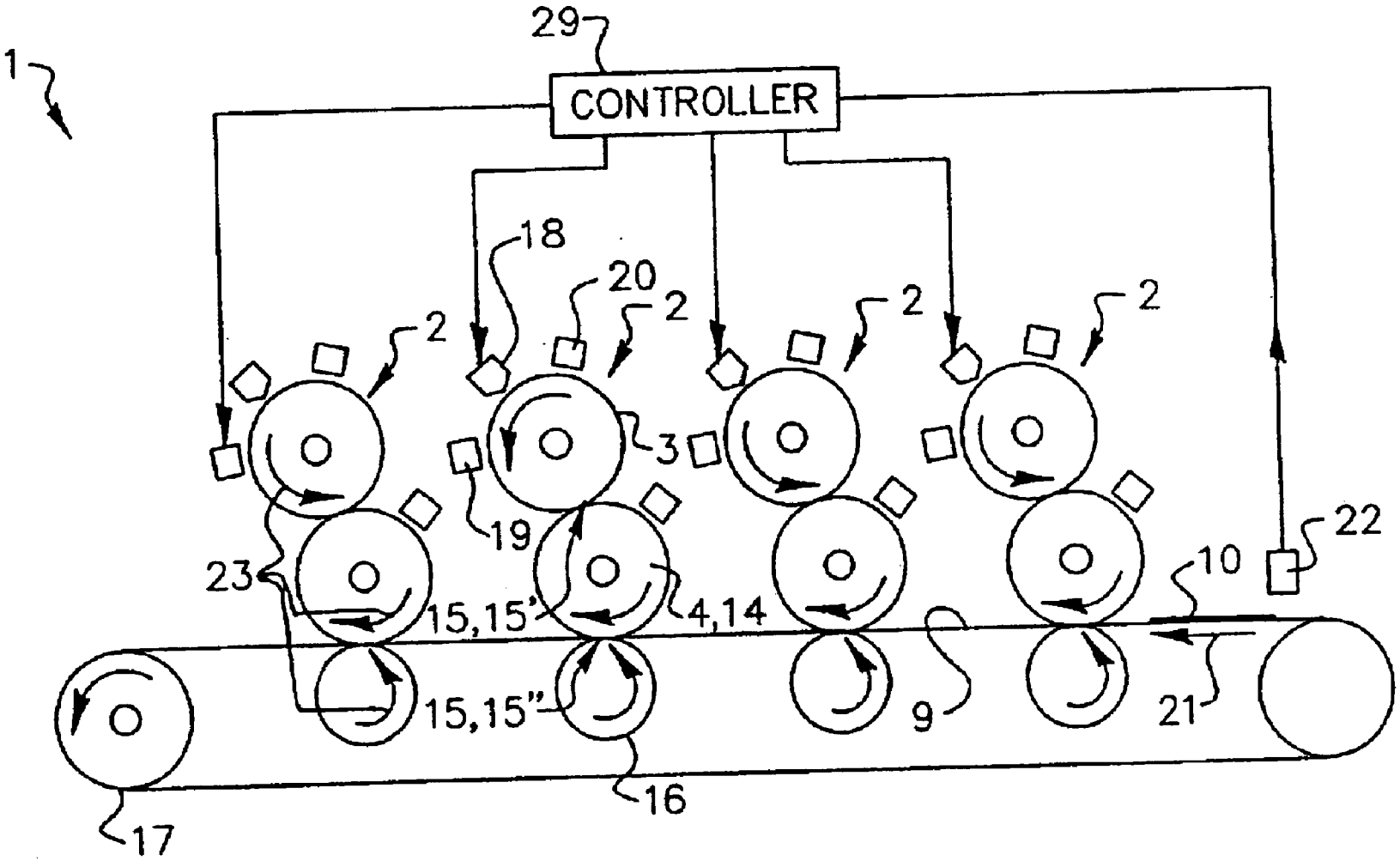
FIG. 1 shows an example of a printing machine, which can be equipped in accordance with the invention.

FIG. 1 shows a printing machine 1 which can be configured in accordance with the invention. This printing machine 1 has at least one printing unit 2, as a rule four such printing units 2. Each printing unit 2 has an image cylinder 3 and an element 4 with an elastic covering, to which the image 5 is transferred. In the exemplary embodiment of the printing machine 1 illustrated, the element 4 is an image transfer cylinder 14, which is driven by the carrier 9 or printing substrates 10 on the latter, the transfer of force being achieved by a partial wrap.

Also provided is a carrier 9, which carries the printing substrates 10 and is driven by a drive roller 17. On the carrier 9, opposite the image transfer cylinders 14, there are impression cylinders 16, which support the image transfer mechanically and electrostatically.

Arranged on the image cylinders 3 is equipment 18 for image production. In the exemplary embodiment, this is equipment for digital electrostatic image production. Furthermore, on the image cylinders 3 there is equipment 19 for toner application and equipment 20 for the removal of the toner not transferred to the image transfer cylinder 14.

The images 5 produced by the equipment 18, in the case of a multicolor printing machine 1 these are color separations of the various printing colors, are produced anew for each printed page and are then transferred, by an image transfer 15, 15', from the image cylinder 3 to the image transfer cylinder 14. A further image transfer 15, 15" takes place from the image transfer cylinder 14 to the printing substrates 10, which are located on the carrier 9. The arrow 21 shows the transport direction of the printing substrates 10, and the arrows 23 show the direction of rotation of the cylinders. The printing substrates 10 are detected by a sensor 22, which is connected to a controller 29 for controlling the equipment for image production 18.

Figure 2:
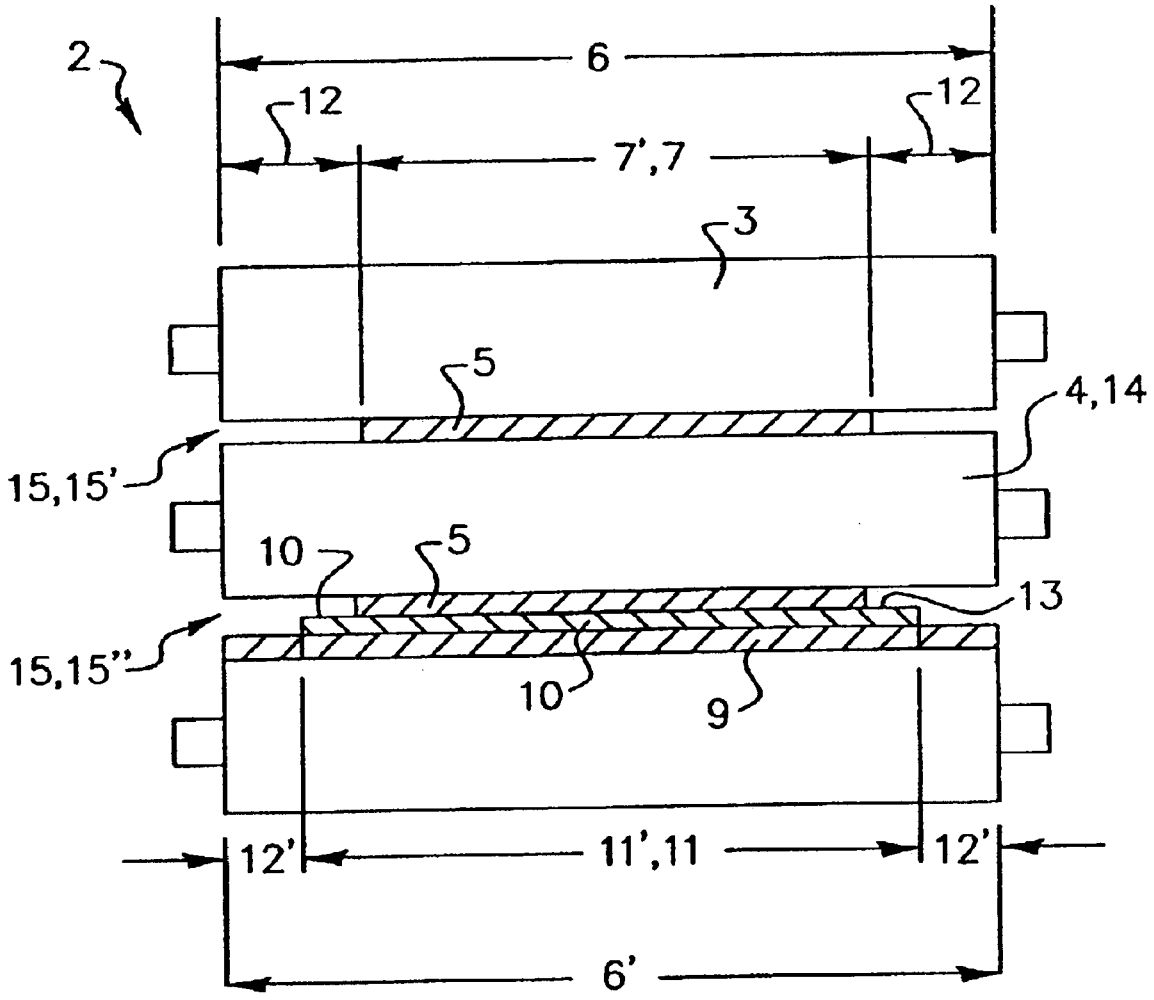
FIG. 2 shows a printing unit of such a printing machine.

FIG. 2 shows a printing unit 2 of a printing machine 1 configured in accordance with the invention, in a view perpendicular to the transport direction 21 of the printing substrates 10. In this case, the same reference symbols correspond to the parts already described in relation to FIG. 1.

However, in the upper part of this illustration, differing from FIG. 1, the case is shown in which the drive is carried out via the image transfer cylinder 14. In this case, an image transfer 15' takes place from the image cylinder 3 to the image, transfer cylinder 14, the image 5 having a width 7'. If this image width 7' corresponds to the maximum image width 7, there must be a minimum difference 12 between this maximum image width 7 and the minimum width 6 of the image cylinder 3, in order to achieve the constancy of rotational speed achieved by the invention with respect to changes in image 5 and printing substrate 10.

If the drive to the image cylinders 3 is carried out via the carrier 9, as in FIG. 1, the image 5 being transferred to the printing substrate 10, it is then necessary for the minimum widths 6' of the image cylinder 3 and of the further elements 4 and 9 that carry images or substrates to have a minimum difference 12' from the maximum printing-substrate width 11. Shown here is a printing-substrate width 11' which corresponds to the maximum printing-substrate width 11.

In the illustration in FIG. 2, for reasons of simplicity, the minimum width 6, in the case of a pure image transfer 5 in the drive train for the image cylinder 3 is drawn with the same dimension as the minimum cylinder width 6' in the case of an image transfer to a printing substrate 10 in such a drive train. In fact, it is, of course, necessary for the minimum image width 7' to be correspondingly greater than the minimum image width 6, in order to take account of the greater width 11 of the printing substrate 10 with respect to the minimizing image width 7' of the image 5 in the case of the same machine but with drive to the image cylinder 3 via the carrier 9. These dimensions have been illustrated correctly in FIG. 3.

Figure 3:
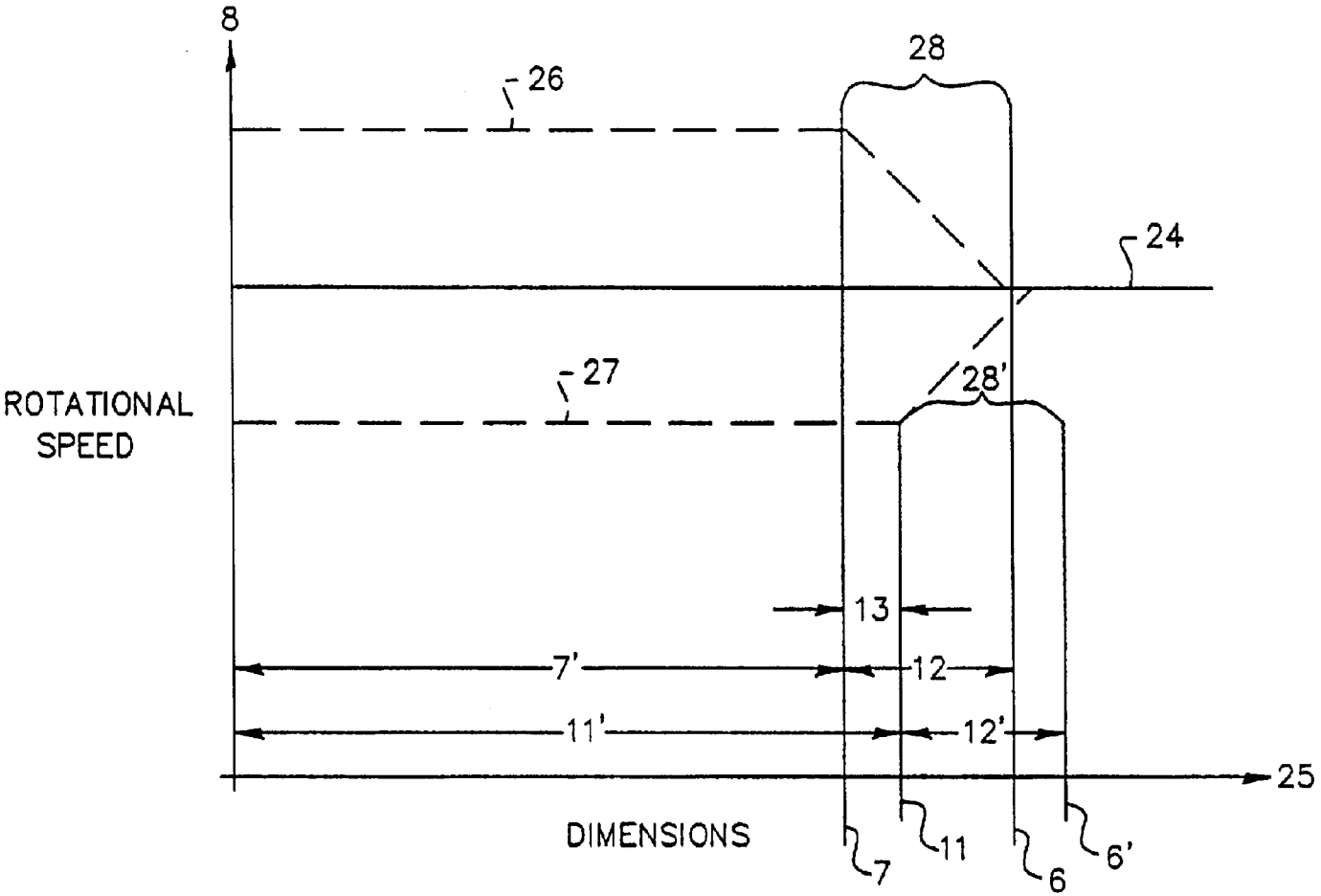
FIG. 3 shows a diagram to explain the configuration according to the invention.

FIG. 3 shows a diagram to explain the configuration according to the invention. In FIG. 3, the rotational speed 8 of the image cylinder 3 is plotted against the dimensions 25 with respect to the width of image and printing substrate as a ratio of the width of image cylinder and elements onto which the image is transferred.

If the image cylinder 3 is driven without the toner of an image 5 and/or a printing substrate 10 being located in the force transmission path in the case of transmission of force by friction, then the rotational speed 24 of the image cylinder 3 is constant.

If an image 5 is transferred between the image cylinder 3 and a driving element 4, then the rotational speed profile 26 occurs; this is caused by deformation of the elastic covering of the image transfer cylinder 14. The rotational speed profile 27 occurs when a printing substrate 10 is on the carrier 9, since said substrate changes the effective radius of the image transfer cylinder 14. At the same time, a range 28 is produced in which the rotational speed 8 of the image cylinder 3 is not constant for different images, that is to say different toner profiles, toner thickness, toner distribution and image widths. It is, therefore, necessary for the minimum width 6 of the image cylinder 3 and the maximum image width 7 to be located outside this range 28. This is achieved by the minimum difference 12 between the maximum image width 7 and the minimum width 6 of the image cylinder 3 being maintained.

If the transmission of force occurs via an image transfer point 15", in which the image 5 is applied to a substrate 10, then it is necessary for a range 28' to be avoided in which the rotational speed 8 of the image cylinder 3 is not constant. In this case, the minimum width 6' of the image cylinder 3 is essentially increased by the image-free edge 13 of the printing substrate 10. Here, too, a minimum difference 12' between the maximum printing-substrate width 11 and the minimum width 6' of the image cylinder 3 and of the elements 4 must be maintained, in order to achieve constancy of the rotational speed 8 with respect to changes in the printing substrate 10, such as printing-substrate thickness, width and other properties. The elements 4 may be the carrier 9, if the latter drives the image cylinder 3 directly, or can also be the carrier 9 and the image transfer cylinder 14, if the machine is constructed in such a way as illustrated in FIG. 1 and FIG. 2.

When an image cylinder 3 is driven by frictional surface of element 4, the drive force to the image cylinder depends on the coefficient of friction (COF) between image cylinder and the frictional component. The COF has one value for the image cylinder and frictional surface. The COF has a second, generally lower value when toner is added to the interface between the image cylinder and the frictional surface.

The image cylinder 3 has some residual torque due to its mounting and bearings. The drive force transmitted from the frictional element to the image cylinder must always exceed the residual drive torque of the image cylinder otherwise the image cylinder will slip relative to the frictional element causing an image defect.

The drive force transmitted to the image cylinder is a function of the width 5 of the toned area between the frictional element and the image cylinder. There is one drive force available when there is no toner in the interface between the frictional element and the image cylinder. There is a second, generally lower drive force available when the full width of the interface is filled with toner. Often the residual torque required to drive the image cylinder will exceed this second, lower value. When this is the case, one must limit the proportion of the interface that is filled with toner to avoid slip and the resultant image defects.

The basic properties of machine 1 are as follows:

| | |
|---|---|
| DrumWidth = 300 mm | Roller Radius = 182 mm |
| NipWidth = 6 mm | COF_Toned = 0.3 |
| DragTorque = 0.0002 N m | COF_Untoned = 1.2 |
| EngagementForce = 0.01 N/m | |

The maximum residual force that can be driven without slip is:

$$\text{ResidualForce}=\text{Drag/Torque/RollerRadius}$$

The maximum drive force available can be calculated as a function of toned width as follows:

$$\text{UntonedWidth}=\text{DrumWidth}-\text{TonedWidth}$$

$$\text{DriveForce}=(\text{TonedWidth}\times\text{COF_Toned}+\text{UntonedWidth}\times\text{COF_Untoned})\times\text{Engagement Force}.$$

Figure 4:
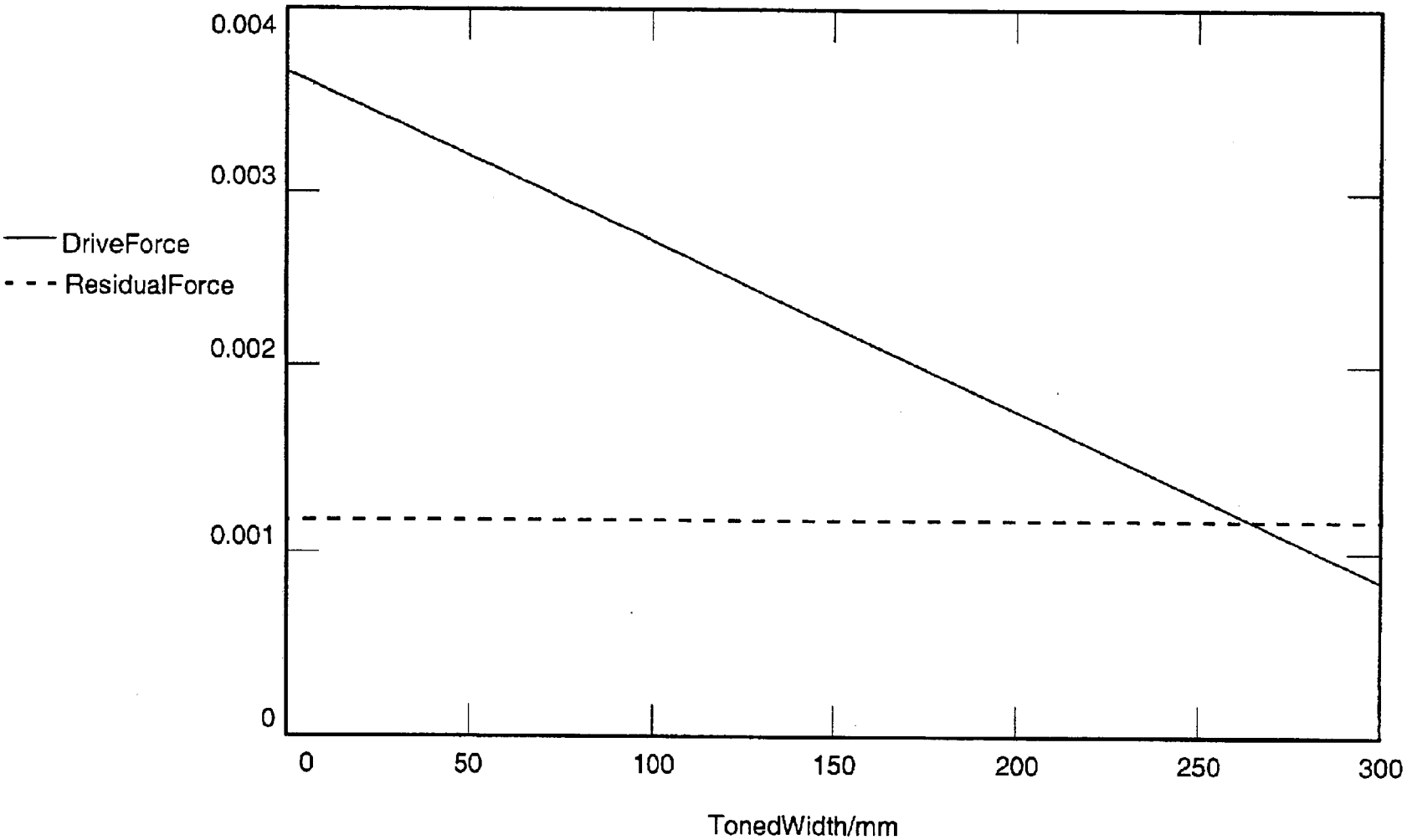
FIG. 4 is a graphical representation of drive force divided by residual force plotted against toned width.

The graph shown in FIG. 4 plots the maximum drive force available as a function of toned-width as a solid line and the residual force as a dashed line. In this case, there is sufficient drive torque until the toned width exceeds 285 mm at which point the available drive force equals the residual force that must be driven. If the toned width increases beyond this point there will not be sufficient force to drive the image cylinder and the cylinder will slip with respect to the frictional element.

As already mentioned in relation to FIG. 3, the invention is of course not restricted to the configuration of a printing machine as illustrated in FIGS. 1 and 2. In addition to the direct transfer of the images 5 from image cylinders 3 to the printing substrates 10, it is additionally possible for an image transfer element to collect the images 5 of all the image cylinders 3 and then to transfer these jointly to a printing substrate 10. Nor is the invention restricted to electrostatic image production, nor at all to digital image production; even in the case of transferring ink instead of toner, the aforementioned effect of a change in the rotational speed of image cylinders occurs, and can be solved in accordance with the invention. It is, therefore, possible for all types of printing machines to be configured in accordance with the invention.

PARTS LIST

1 Printing machine
2 Printing unit
3 Image cylinder
4 Element to which the image is transferred
5 Image
6, 6' Minimum width of the image cylinder and further elements carrying images or substrates
6 In the case of pure image transfer within the drive train for the image cylinder
6' In the case of image transfer to a printing substrate within the drive train for the image cylinder
7 Maximum image width
7' Image width
8 Rotational speed of the image cylinder
9 Carrier, which carries the printing substrates
10 Printing substrates
11 Maximum printing-substrate width
11' Printing-substrate width
12 Minimum difference between maximum image width and the width of the image cylinder and further elements that carry images or substrates (9, 14)
12' Minimum difference between maximum printing-substrate width and the width of the image cylinder and further elements that carry images or substrates (9, 14)
13 Image-free edge of the printing substrate
14 Image transfer cylinder
15 Image transfer
15' Image transfer from image cylinder to image transfer cylinder
15" Image transfer from image transfer cylinder to printing substrate
16 Impression cylinder
17 Drive roller of the carrier
18 Equipment for image production
19 Equipment for toner application
20 Equipment for toner removal
21 Arrow: transport direction of the printing substrates

22 Sensor for detecting printing substrates
23 Arrow: direction of rotation of the cylinders
24 Rotational speed of the image cylinder without any toner application, that is to say without image transfer
25 Dimensions (width of image, printing substrate, image cylinder and elements to which the image is transferred
26 Rotational speed profile of the image cylinder in the case of pure image transfer (toner transfer in the drive train for the image cylinder
27 Rotational speed profile when an image is transferred to a printing substrate in the drive train for the image cylinder
28, 28' Range in which the rotational speed of the image cylinder is not constant
29 Controller

What is claimed is:

1. A printing machine comprising:

at least one printing unit, having an image cylinder driven by friction by an element to which an image produced on image cylinder is transferred, the width of said image cylinder and said element being at least so much wider than the maximum width of the image to be transferred that the rotational speed of the image cylinder remains essentially constant in the event of a change in width of the image wherein said image width and image cylinder width are related according to the formula:

$$\text{DriveForce}=(\text{TonedWidth}\times\text{COF_Toned}+\text{UntonedWidth}\times\text{COF_Untoned})\times\text{Engagement Force}$$

wherein:

$$\text{UntonedWidth}=\text{DrumWidth}-\text{TonedWidth}.$$

2. The printing machine as claimed in claim 1, wherein said element is a carrier which carries printing substrates of varying widths during the printing operation, and the width of said carrier is at least so much wider than the maximum width of a printing substrate that the rotational speed of the image cylinder remains essentially constant in the event of a change in the width of printing substrates.

3. The printing machine as claimed in claim 1, wherein the element is an image transfer cylinder.

4. The printing machine as claimed in claim 3, wherein said image transfer cylinder is driven by carrier for printing substrates of varying widths, and the width of image cylinder, image transfer cylinder and carrier is at least so much wider than the maximum width of a printing substrate that the rotational speed of the image cylinder remains essentially constant in the event of a change in the width of printing substrates.

5. The printing machine as claimed in claim 4, wherein on the side of the said carrier which is opposite that of the image transfer there is arranged an impression cylinder, which likewise has at least the width equal to the width of said image cylinder.

6. The printing machine as claimed in claim 1, wherein said element is a printing substrate carrier is driven via a drive roller.

* * * * *